US009377753B2

(12) United States Patent
Kainuma

(10) Patent No.: US 9,377,753 B2
(45) Date of Patent: Jun. 28, 2016

(54) IMAGE FORMING APPARATUS WITH HEIGHT ADJUSTMENT PORTION FOR FIXING UNIT

(71) Applicant: KYOCERA Document Solutions Inc., Osaka-shi, Osaka (JP)

(72) Inventor: Takashi Kainuma, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/489,311

(22) Filed: Sep. 17, 2014

(65) Prior Publication Data

US 2015/0086241 A1 Mar. 26, 2015

(30) Foreign Application Priority Data

Sep. 20, 2013 (JP) ..... 2013-195330

(51) Int. Cl.
*G03G 15/16* (2006.01)
*G03G 15/20* (2006.01)
*G03G 21/16* (2006.01)

(52) U.S. Cl.
CPC ..... *G03G 21/1685* (2013.01)

(58) Field of Classification Search
CPC ..... G03G 21/1685
USPC ..... 399/122, 328
See application file for complete search history.

(56) References Cited

FOREIGN PATENT DOCUMENTS

JP 2008046154 A 2/2008
JP 2012247466 A 12/2012

*Primary Examiner* — Hoang Ngo
(74) *Attorney, Agent, or Firm* — Alleman Hall McCoy Russell & Tuttle LLP

(57) ABSTRACT

An image forming apparatus includes a fixing unit, a first support portion, and a second support portion. First support portion fits with and positions first supported portion, which is end of fixing unit, in up-down direction and supports first supported portion movably in insertion direction of fixing unit toward attachment position. Second support portion fits with and positions second supported portion, which is another end of fixing unit, in up-down direction and supports second supported portion movably in insertion direction. Height adjustment portion adjusts height position of fixing unit by moving second support portion in up-down direction. The first support portion includes vertical surface facing first supported portion and extending in up-down direction, and vertical surface has projection at an end thereof on foreside of insertion direction, the projection projecting from the vertical surface in first direction of going away from the vertical surface.

5 Claims, 10 Drawing Sheets

IMAGE FORMING APPARATUS WITH HEIGHT ADJUSTMENT PORTION FOR FIXING UNIT

INCORPORATION BY REFERENCE

This application is based upon and claims the benefit of priority from the corresponding Japanese Patent Application No. 2013-195330 filed on Sep. 20, 2013, the entire contents of which are incorporated herein by reference.

BACKGROUND

The present disclosure relates to an image forming apparatus in which a fixing unit is provided in such a manner that it can be attached and detached to/from the apparatus main body, and in particular to an image forming apparatus including a height adjustment portion configured to adjust the height position of the fixing unit.

Conventionally, an image forming apparatus is provided with a fixing unit, wherein the image forming apparatus is a copier, a printer, a facsimile, or a multifunction peripheral, in which these functions are installed, or the like. The fixing unit includes: a heating roller in which a heater is embedded; and a pressure roller which is pressed against the heating roller. The pressure roller is rotatably supported by the casing of the fixing unit. In the state where the fixing unit has been attached to the apparatus main body of the image forming apparatus, the rotational driving force is transmitted from the apparatus main body to the heating roller. This causes the heating roller to rotate in a direction. When a transfer sheet passes through a nip portion between the heating roller and the pressure roller, the toner on the transfer sheet is fused by the heating roller, and an image drawn on the transfer sheet with the toner is fixed onto the transfer sheet.

This type of image forming apparatus is provided with a drive transmission mechanism, such as a motor, configured to transmit the rotational driving force to the heating roller of the fixing unit. The drive transmission mechanism is connected to an end of the rotation shaft of the heating roller in the state where the fixing unit has been attached to the apparatus main body.

In addition, there is known, as an example of the image forming apparatus, an image forming apparatus that is provided with a height adjustment mechanism configured to adjust the height position of the fixing unit attached to the apparatus main body. With this height adjustment mechanism, the parallelism of the heating roller and the conveying roller for conveying the transfer sheet can be adjusted with high accuracy.

The image forming apparatus is provided with a slide support mechanism for guiding the fixing unit to and supporting it at the attachment position. As an example of the slide support mechanism, there is known a rail support mechanism in which the fixing unit is horizontally slidably supported by rails or guide grooves that are provided at opposite ends of the fixing unit in the longitudinal direction (a direction matching the axis direction of the heating roller).

SUMMARY

An image forming apparatus according to an aspect of the present disclosure includes a fixing unit, a first support portion, and a second support portion. The fixing unit is attached to an apparatus main body of the image forming apparatus. The first support portion is fixed to the apparatus main body, fits with and positions a first supported portion, which is an end of the fixing unit, in an up-down direction and supports the first supported portion movably in insertion direction of the fixing unit toward an attachment position. The second support portion is provided movably in the up-down direction with respect to the apparatus main body and fits with and positions a second supported portion, which is another end of the fixing unit, in the up-down direction and supports the second supported portion movably in the insertion direction. The height adjustment portion adjusts height position of the fixing unit by moving the second support portion in the up-down direction. The first support portion includes a vertical surface facing the first supported portion and extending in the up-down direction, and the vertical surface has a projection at an end thereof on foreside of the insertion direction, the projection projecting from the vertical surface in a first direction of going away from the vertical surface.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
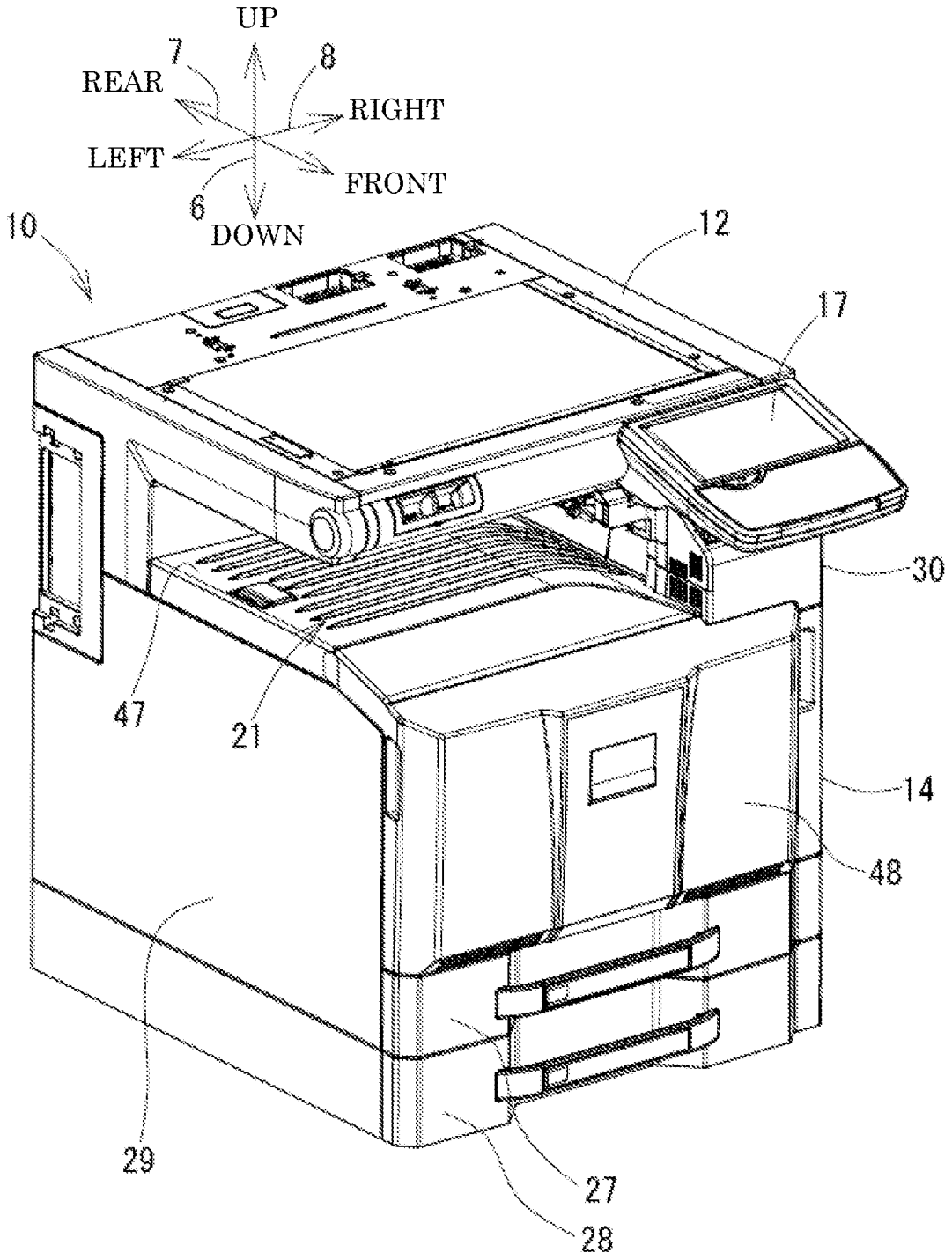
FIG. 1 is a perspective view of the image forming apparatus according to the embodiment of the present disclosure.

The following describes an image forming apparatus 10 according to an embodiment of the present disclosure. It is noted that for the sake of explanation, an up-down direction 6 is defined as the vertical direction in the state (state shown in FIG. 1) where the image forming apparatus 10 is installed on a flat surface. In addition, a front-rear direction 7 is defined on the supposition that a surface on which an operation display panel 17 is provided is the front surface (front side). Furthermore, a left-right direction 8 is defined based on the front surface of the image forming apparatus 10. It is noted that the embodiment described in the following is merely a concrete example of the present disclosure, and is not intended to limit the technical scope of the present disclosure.

First, an outlined configuration of the image forming apparatus 10 will be described with reference to FIGS. 1 and 2. The image forming apparatus 10 is a so-called "in-body discharge type" multifunction peripheral, and has various functions such as a printer, a copier, a facsimile, a scanner, and the like. Note that the image forming apparatus 10 is not limited to a multifunction peripheral, and the present disclosure is also applicable to a specialized device such as a printer, a copier, a facsimile or the like.

Figure 2:
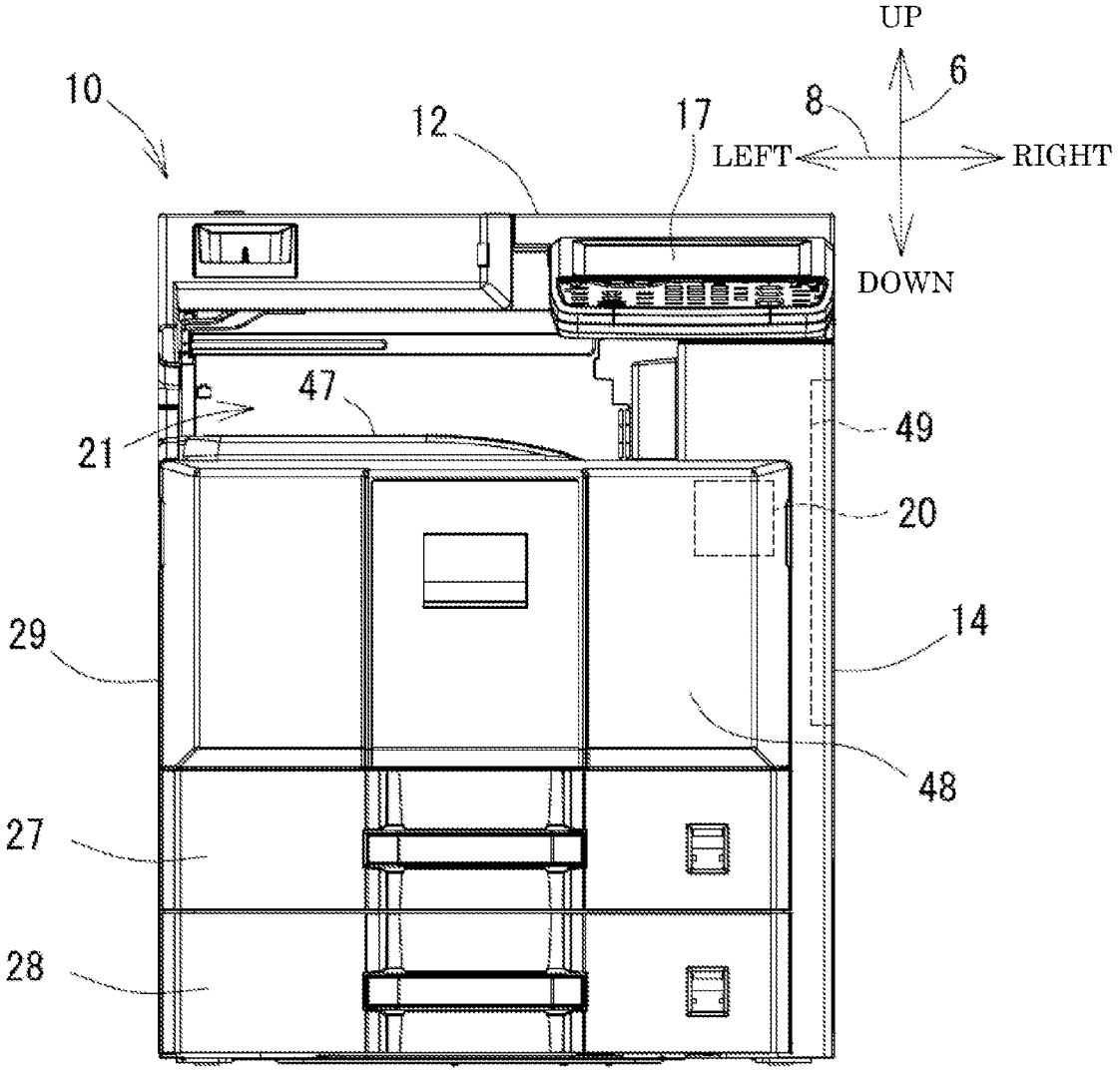
FIG. 2 is a front view showing the front side of the image forming apparatus of FIG. 1.

As shown in FIGS. 1 and 2, the image forming apparatus 10 includes an image reading portion 12 and an image forming portion 14. The image reading portion 12 performs a process of reading an image from a document sheet, and is provided in the upper portion of the image forming apparatus 10. The image forming portion 14 performs a process of forming an image based on the electrophotography, and is provided in the lower portion of the image forming apparatus 10. The image forming portion 14 includes two sheet feed devices 27 and 28 that are arranged as two tiers in the vertical direction. The sheet feed device 27, the upper one of the two sheet feed devices, is formed as one unit with a housing 29 (an example of the apparatus main body of the present disclosure) in the lowest portion of the image forming portion 14. The sheet feed device 28, the lower one of the two sheet feed devices, is extension-type and is attached to the bottom surface of the housing 29 as an option device. The sheet feed device 28 is configured to be attachable/detachable to/from the bottom surface of the housing 29. It is noted that in FIGS. 1 and 2, a document sheet cover of the image reading portion 12 is omitted to be shown.

The image forming portion 14 forms an image on a print sheet based on image data read by the image reading portion 12 or image data input from outside. The image forming portion 14 includes, as main parts, the sheet feed devices 27 and 28, a transfer device (not shown), a fixing unit 20 (see FIGS. 2 and 3), an operation display panel 17, and a drive transmission portion 45 (see FIG. 3). The sheet feed devices 27 and 28 are configured to hold print sheets. The fixing unit 20 fixes a toner image, which has been transferred on a print sheet, to the print sheet. These components are disposed within the housing 29 that constitutes the apparatus main body of the image forming portion 14.

A sheet discharge space 21 is provided between the upper surface of the image forming portion 14 and the image reading portion 12. The sheet discharge space 21 is opened in the front direction. In the sheet discharge space 21, a sheet discharge tray 47 is provided. A print sheet conveyed from the sheet feed device 27 or 28 is moved upward in a conveyance path (not shown) formed in the housing 29, and during the process of moving, a toner image is transferred on the print sheet. The toner image transferred on the print sheet is fused and fixed to the print sheet while the print sheet is being passed through the fixing unit 20 and thereby heated. The print sheet having passed through the fixing unit 20 is discharged into the sheet discharge space 21 and held by the sheet discharge tray 47.

A front cover 48 is provided on the front side of the image forming portion 14. The front cover 48 is supported by the housing 29 so as to be opened and closed. When the front cover 48 is opened, the front side of the image forming portion 14 is opened and the inside thereof is exposed. In addition, as shown in FIG. 2, a side cover 49 is provided on the right side of the image forming portion 14. The side cover 49 is supported by the housing 29 so as to be opened and closed. When the side cover 49 is opened, the right side of the image forming portion 14 is opened and the inside thereof is exposed. In the present embodiment, when the side cover 49 is opened, the fixing unit 20, support plates 55 and 56 that support the fixing unit 20, and the like are exposed. This enables a worker to attach and detach the fixing unit 20 to/from the housing 29. In addition, when the front cover 48 is opened, a height adjustment mechanism 80, which is described below and is for adjusting the height position of the fixing unit 20, is exposed. This enables a worker to operate the height adjustment mechanism 80 to adjust the height position of the fixing unit 20.

As shown in FIG. 2, the fixing unit 20 is provided in the upper right side of the housing 29. The fixing unit 20 is supported in such a manner that it is slidable in the left-right direction 8 to be inserted into and pulled out from the housing 29 horizontally. Specifically, the fixing unit 20 is supported in such a manner that it is slidable between an attachment position and a pulled-out position, wherein the attachment position is a predetermined distance away leftward from the right side of the housing 29, and the pulled-out position is on the right side of the housing 29 to which the fixing unit 20 is pulled out. When the fixing unit 20 has been attached to and is disposed at the attachment position, the rotational driving force can be transmitted from the drive transmission portion 45 (see FIG. 3) in the image forming portion 14 to the fixing unit 20. When the fixing unit 20 is pulled out from the attachment position rightward and is in a non-attachment state, the transmission of the rotational driving force from the drive transmission portion 45 is interrupted.

Meanwhile, in a typical image forming apparatus that includes: a conventional slide support mechanism for supporting the fixing unit; and a conventional height adjustment mechanism, an end of the fixing unit to which the rotational driving force is transmitted from the drive transmission portion (a driven side end) needs to be positioned accurately to prevent a connection dislocation or a disconnection from the drive transmission portion. As a result, the slide support mechanism is configured to support the fixing unit slidably in a state where the driven side end can be positioned in the up-down direction and an opposite end thereof (an adjustment side end) can be adjusted by the height adjustment mechanism. In this configuration, the height adjustment mechanism moves the adjustment side end of the fixing unit in the up-down direction so as to move the fixing unit to a position where the fixing unit rotates around a support point of the driven side end. In a slide support mechanism having such a configuration, in order to secure the guide function of the slide support mechanism guiding in the slide direction, it is necessary to have a large fitting width for the fitting with the rails or the guide grooves. However, when a fitting width of the adjustment side end of the fixing unit is increased, a movement width (a height adjustment width) of the adjustment side end of the height adjustment mechanism in the up-down direction is restricted to a small width. On the other hand, when the fitting width of the adjustment side end is decreased in order to increase the movement width of the height adjustment mechanism, the guide function of the slide support mechanism in the slide direction is not secured, and it becomes difficult for the fixing unit to be moved smoothly in the slide direction.

According to the image forming apparatus 10 of the present disclosure, the fixing unit 20 and the mechanism for supporting it are configured such that the adjustment width of the fixing unit 20 in the height direction can be secured sufficiently, and the fixing unit 20 can be moved smoothly in the slide direction.

Figure 3:
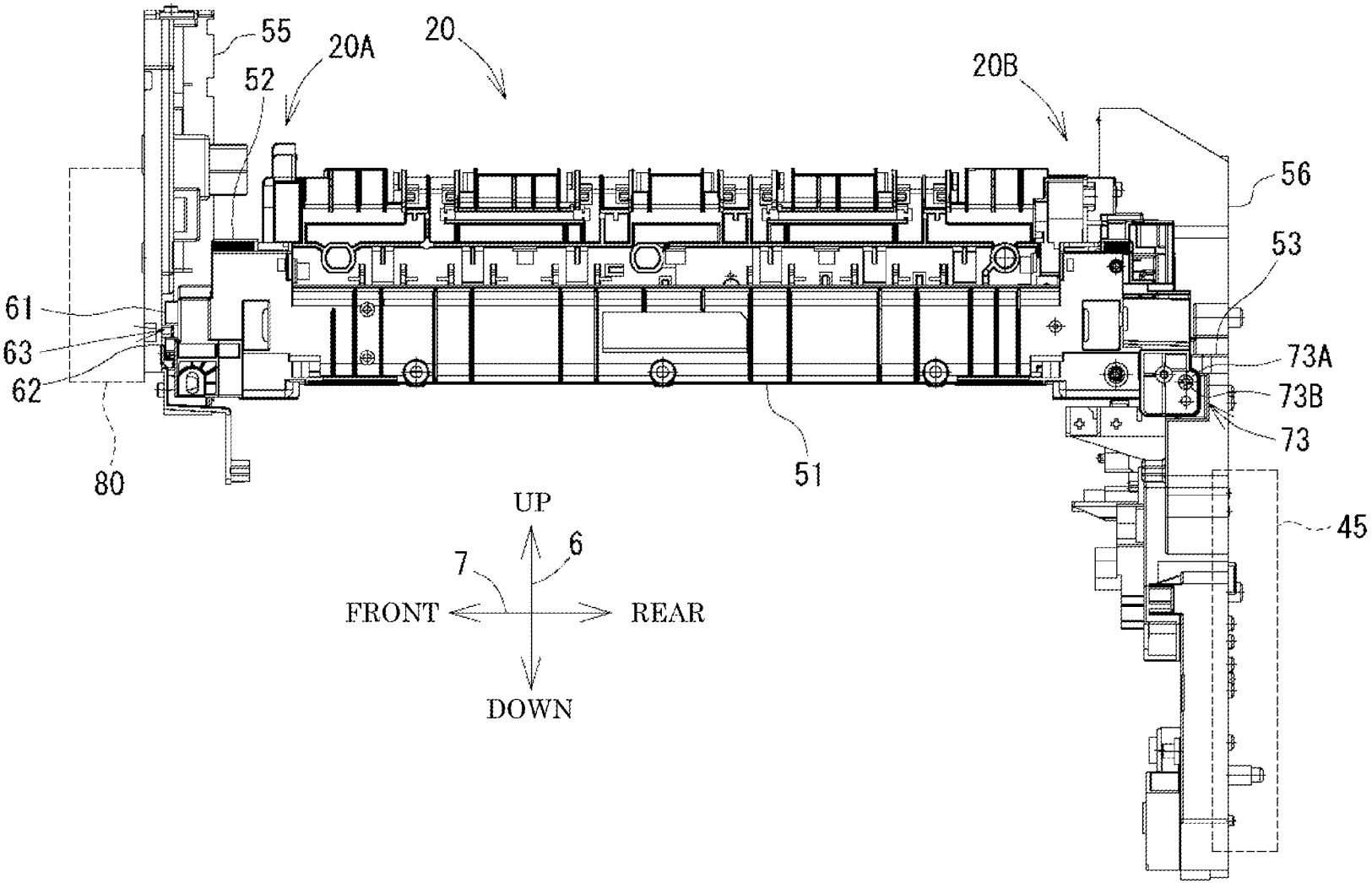
FIG. 3 is a diagram showing the peripheral configuration of the fixing unit attached to the image forming apparatus of FIG. 1.

In the following, the configuration of the fixing unit 20 and the mechanism for supporting it will be described in detail with reference to FIGS. 3 through 9. Here, FIG. 3 is a diagram showing the fixing unit 20 in the attached state, and is a diagram when the image forming portion 14 is viewed from the right side. It is noted that these drawings show the members in the posture where they have been attached to the housing 29, and for the sake of explanation, the up-down direction 6, front-rear direction 7, and left-right direction 8 are indicated based on this attachment posture of the members.

Figure 4:
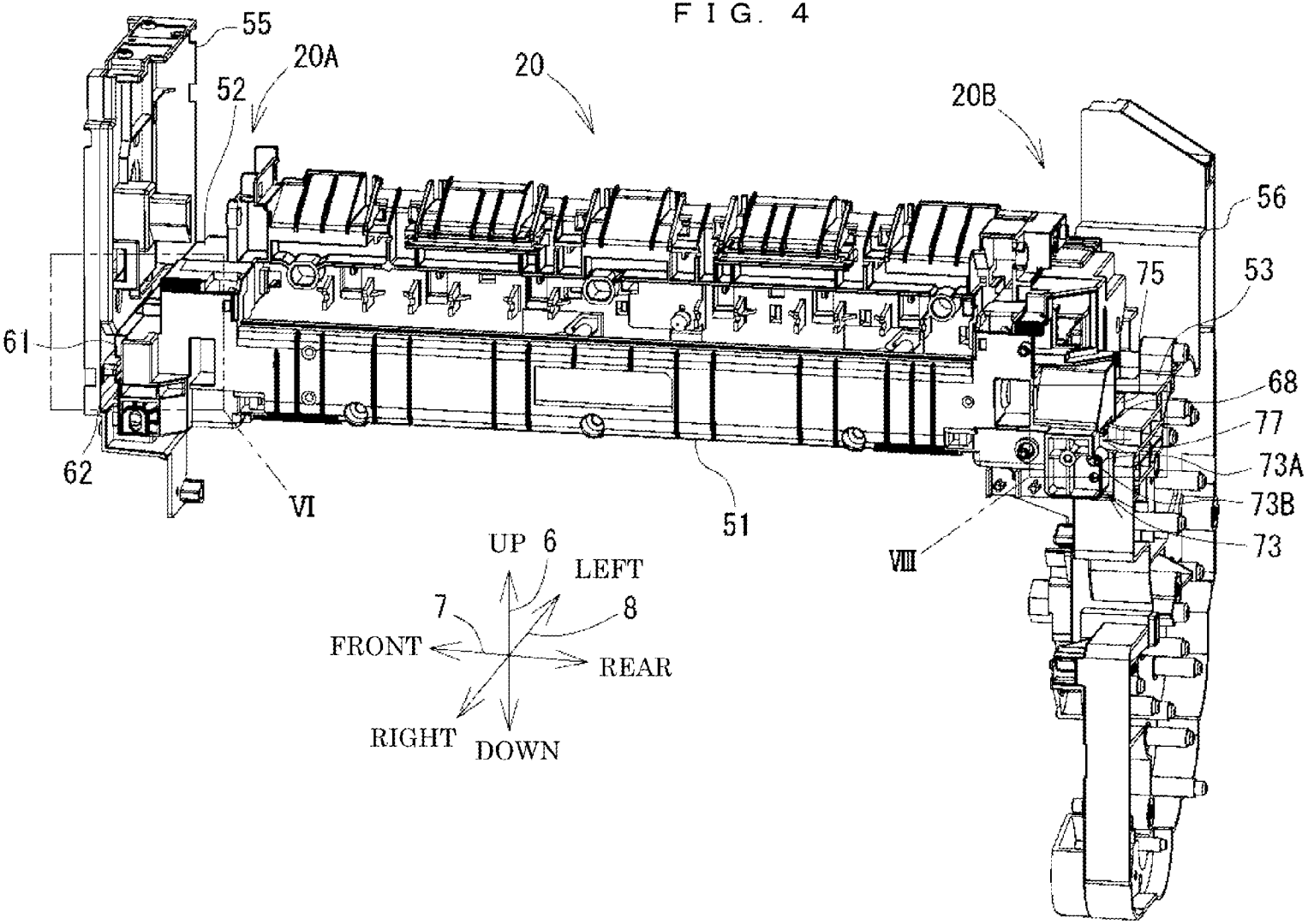
FIG. 4 is a perspective view showing the configuration of the fixing unit of FIG. 3 and the mechanism for supporting it.
Figure 5:
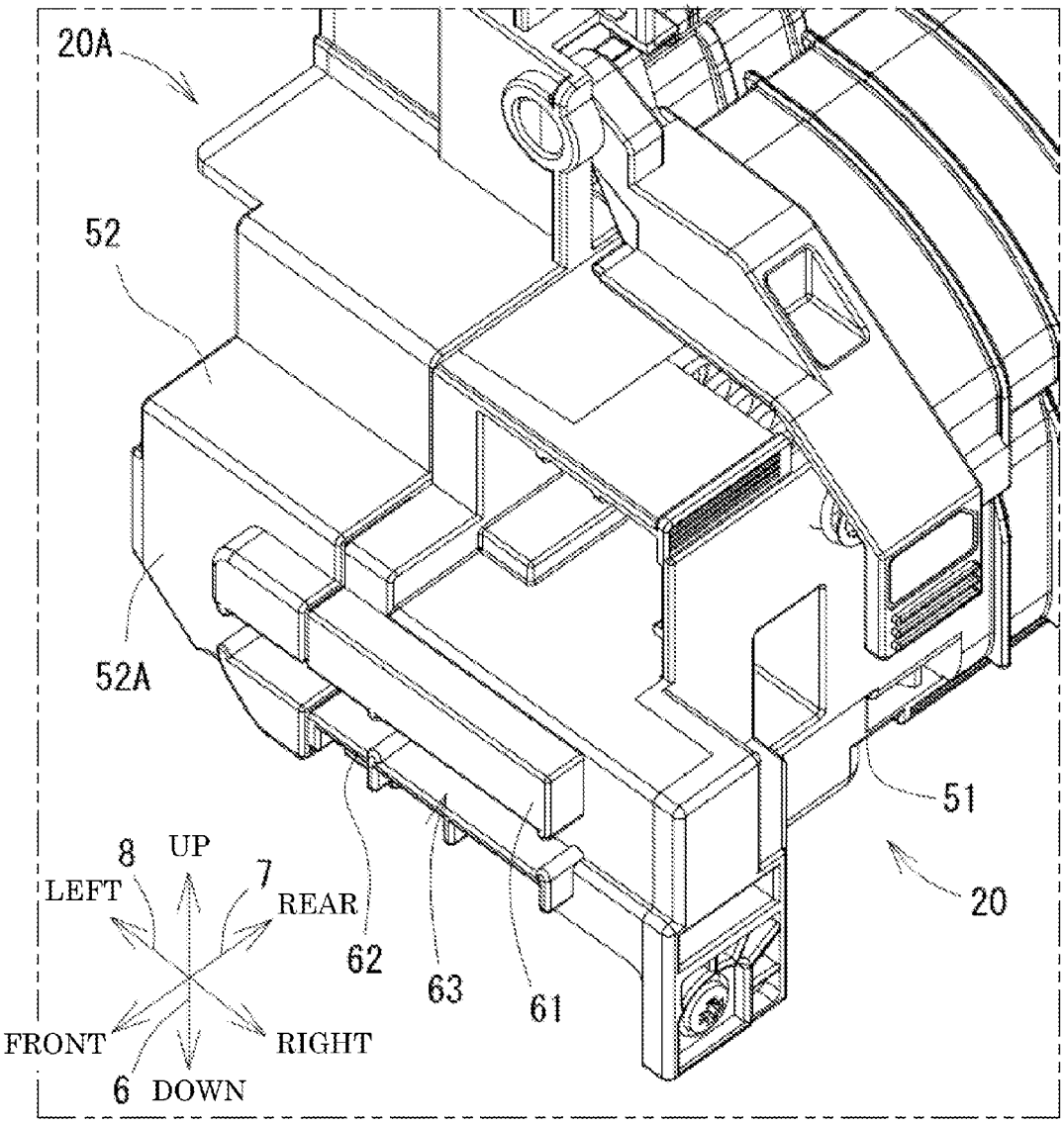
FIG. 5 is a perspective view showing the front end of the fixing unit of FIG. 3.

As shown in FIGS. 3 through 5, the fixing unit 20 is elongated in shape in the front-rear direction 7 and includes a base frame 51 and side frames 52 and 53, wherein the base frame 51 is elongated in the front-rear direction 7, and the side frames 52 and 53 are provided at the opposite ends of the base frame 51. A heating roller and a pressure roller (not shown) are supported rotatably in an internal space surrounded by the frames 51 through 53. Specifically, rotation shafts of the heating roller and the pressure roller are supported rotatably by bearings (not shown) formed in the side frames 52 and 53. A front end 20A of the fixing unit 20, which is on the front side, is configured as the side frame 52 on the front side. A rear end 20B of the fixing unit 20, which is on the rear side, is configured as the side frame 53 on the rear side. The frames 51 through 53 are synthetic resin products formed by the injection molding in which a mold is filled with melted synthetic resin, and then the resin is hardened.

It is noted that the fixing unit 20 is provided with a heating device such as a heater for heating the heating roller, and the surface temperature of the heating roller is increased to a high temperature by the heating device. As a result, among synthetic resins, a PET resin (polyethylene terephthalate), which has excellent heat resistance and strength, or a synthetic resin having the PET resin as the major component is used as the material of the frames 51 through 53 of the fixing unit 20. Of course, the frames 51 through 53 may be formed from a synthetic resin other than the PET resin as far as it is resistant to the high-temperature environment in the fixing unit 20.

As shown in FIG. 3, the height adjustment mechanism 80 is provided on the front side of the fixing unit 20, that is, further in front of the side frame 52. The front end 20A of the fixing unit 20 is supported movably in the up-down direction 6 by the height adjustment mechanism 80. The height position of the fixing unit 20 is adjusted in the up-down direction 6 as the front end 20A is moved in the up-down direction 6 by the height adjustment mechanism 80. The housing 29 includes a support plate 55. The support plate 55 is disposed between the front end 20A and the height adjustment mechanism 80. That is, the height adjustment mechanism 80 is disposed in front of the support plate 55. Details of the support plate 55 and the height adjustment mechanism 80 are described below.

As shown in FIG. 3, the drive transmission portion 45 is provided on the rear side of the fixing unit 20, that is, in rear of the side frame 53. The drive transmission portion 45, including a motor, a gear, and the like, transmits the rotational driving force to the rotation shafts of the heating roller and the pressure roller of the fixing unit 20. The housing 29 includes a support plate 56 for supporting the rear end 20B of the fixing unit 20. The support plate 56 is disposed between the rear end 20B and the drive transmission portion 45. Transmission members such as a motor, a gear, and the like (not shown) are attached to the side surface of the rear side of the support plate 56. Details of the support plate 56 and the mechanism for supporting the rear end 20B using the support plate 56 are described below.

Figure 6:
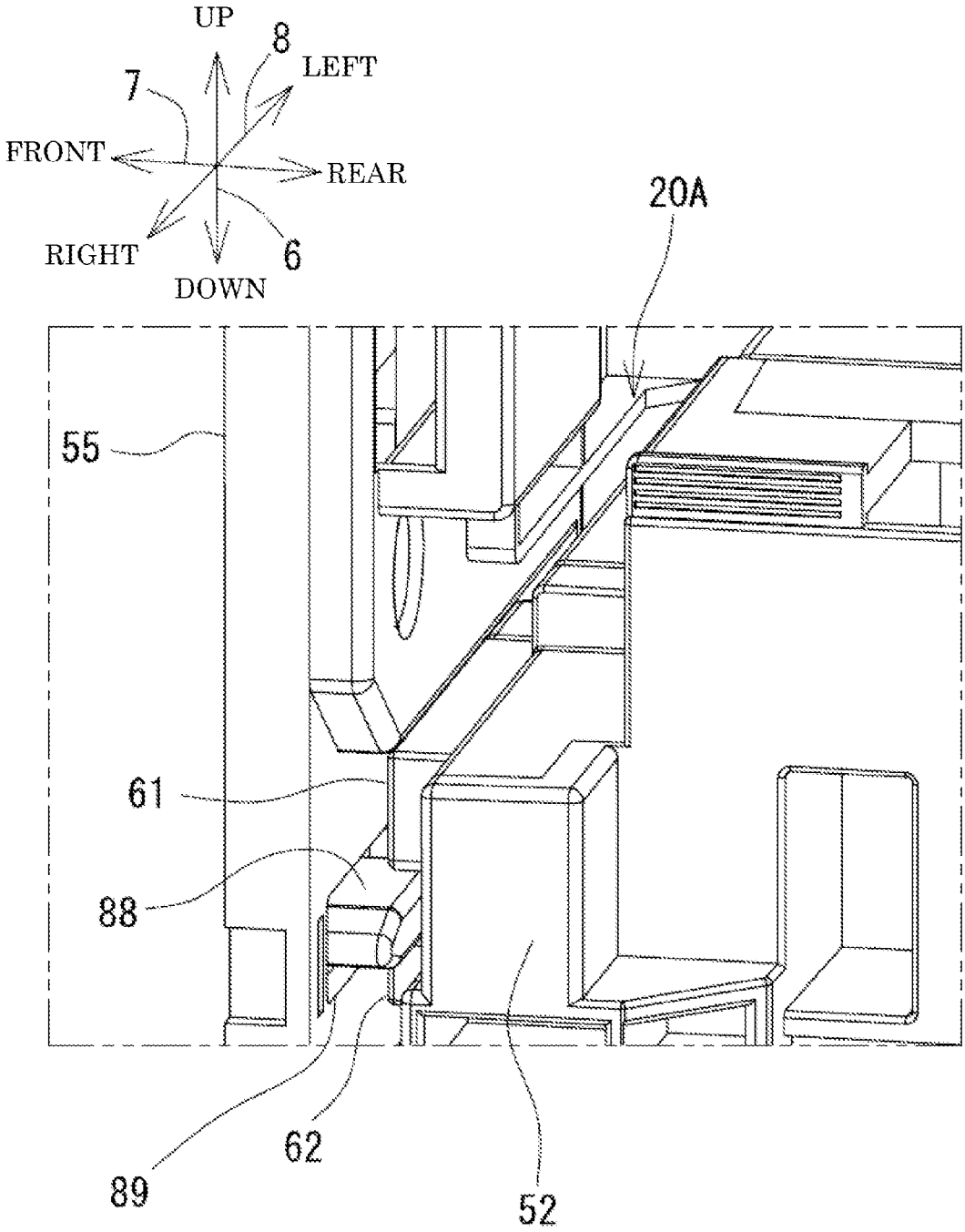
FIG. 6 is a partially enlarged view showing the configuration of the main part VI of FIG. 4.

As shown in FIGS. 5 and 6, a pair of slide guides 61 and 62 (an example of the second supported portion of the present disclosure) are provided on a side surface 52A of the side frame 52 of the fixing unit 20. That is, the slide guides 61 and 62 are provided in the front end 20A of the fixing unit 20. The front end 20A is opposite to the rear end 20B to which the rotational driving force is transmitted from the drive transmission portion 45 (see FIG. 3). The slide guide 61 and the slide guide 62 are disposed to be separated from each other in the up-down direction 6. This allows a guide groove 63 to be formed between the slide guides 61 and 62 to extend in the left-right direction 8. In this guide groove 63, projection ribs 88 of a support member 82 of the height adjustment mechanism 80 are inserted, as described below.

Figure 7:
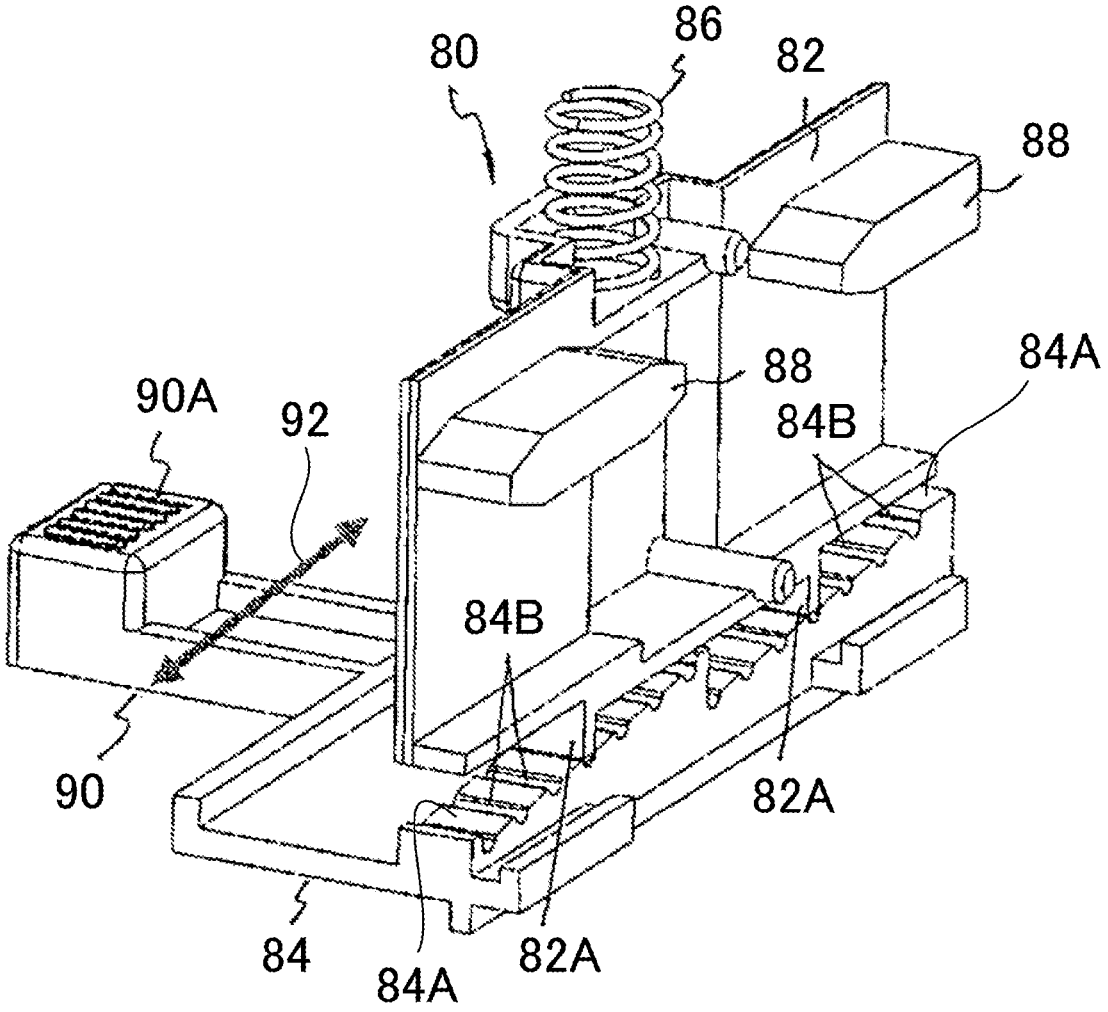
FIG. 7 is a perspective view of the height adjustment portion provided on the support plate of the fixing unit of FIG. 3.

As shown in FIG. 7, the height adjustment mechanism 80 includes the support member 82 (an example of the second support portion of the present disclosure), a height adjustment member 84 (an example of the height adjustment portion of the present disclosure), and a spring 86.

The support member 82 is formed as a plate that is elongated in shape in the up-down direction 6, and is provided on the side surface of the front side of the support plate 55. The support member 82 is provided movably in the up-down direction 6 with respect to the support plate 55 that constitutes part of the housing 29. Two projection ribs 88 are formed as one unit with the support member 82 and as projections from a surface of the support member 82 facing the support plate 55. The projection ribs 88 are provided at the same height to align in the left-right direction 8 (horizontal direction). The projection ribs 88 are inserted through a through hole 89 (see FIG. 6) formed in the support plate 55, and are exposed to the front end 20A side of the fixing unit 20. The projection ribs 88 are inserted from their tips into the guide groove 63 (see FIG. 6) when the fixing unit 20 is inserted and reaches the attachment position and while the fixing unit 20 rests at the attachment position. The guide groove 63 is formed to have a predetermined fitting tolerance to fit with the inserted projection ribs 88. That is, the projection ribs 88 are configured to fit with the guide groove 63. The fitting of the projection ribs 88 with the guide groove 63 causes the support member 82 to position the front end 20A of the fixing unit 20 in the up-down direction 6, and the front end 20A of the fixing unit 20 is supported movably in the insertion direction of the fixing unit 20.

The height adjustment member 84 adjusts the height position of the fixing unit 20 by moving the support member 82 in the up-down direction 6. The height adjustment member 84 supports the support member 82 via two convexes 82A that are formed in the bottom surface of the support member 82. On a supporting surface of the height adjustment member 84, two tapered surfaces 84A are formed in correspondence with the two convexes 82A projecting from the support member 82. That is, the tapered surfaces 84A are formed on the supporting surface of the height adjustment member 84 at positions that correspond to the respective convexes 82A. In each of the tapered surfaces 84A, a plurality of concaves 84B are formed. Since the plurality of concaves 84B are formed in the tapered surfaces 84A, the concaves 84B have different heights that change in a step-like manner.

As shown in FIG. 7, each of the convexes 82A projecting from the support member 82 is selectively engaged with any one of the plurality of concaves 84B formed in the tapered surfaces 84A. The support member 82 is pressed downward by a spring 86 that is an elastic member such as a coil spring. This causes the support member 82 to press the height adjustment member 84 downward. The height adjustment member 84 includes an adjustment lever 90. The adjustment lever 90 extends frontward from the bottom plate of the height adjustment member 84. The adjustment lever 90 projects toward the front cover 48 (see FIG. 1) of the image forming portion 14, and an operation portion 90A is provided at the tip of the projection. The operation portion 90A is disposed in the vicinity of the rear surface of the front cover 48. When the height adjustment of the fixing unit 20 is not performed, the operation portion 90A of the adjustment lever 90 is covered by the front cover 48. When the front cover 48 is opened, the operation portion 90A is exposed, and the worker can adjust the height position of the fixing unit 20 by operating the operation portion 90A.

The height adjustment mechanism 80 having the above-described configuration adjusts the height of the fixing unit 20 as follows. That is, when the height of the fixing unit 20 attached to inside the image forming portion 14 is to be adjusted, the worker opens the front cover 48 (see FIG. 1) to expose the operation portion 90A. The worker then operates the operation portion 90A to slide the adjustment lever 90 in the direction indicated by the arrow 92. This causes the height adjustment member 84 to slide in this direction. As the height adjustment member 84 slides, the convexes 82A projecting from the support member 82 are disengaged from the concaves 84B of the height adjustment member 84 and are engaged with other concaves 84B. As described above, the plurality of concaves 84B have different heights. As a result, when the position at which the convexes 82A are engaged with concaves 84B is changed, the support member 82 and the projection ribs 88 supported by the support member 82 move in the up-down direction 6, and the projection ribs 88 are displaced in height. That is, the height of the front end 20A of the fixing unit 20 supported by the projection ribs 88 and the guide groove 63 is adjusted to a position corresponding to the operation of the adjustment lever 90. This makes it possible to adjust, with high accuracy, the heating roller and the pressure roller of the fixing unit 20 to have the same parallelism as the conveying roller and other rollers provided in the image forming portion 14.

Figure 8:
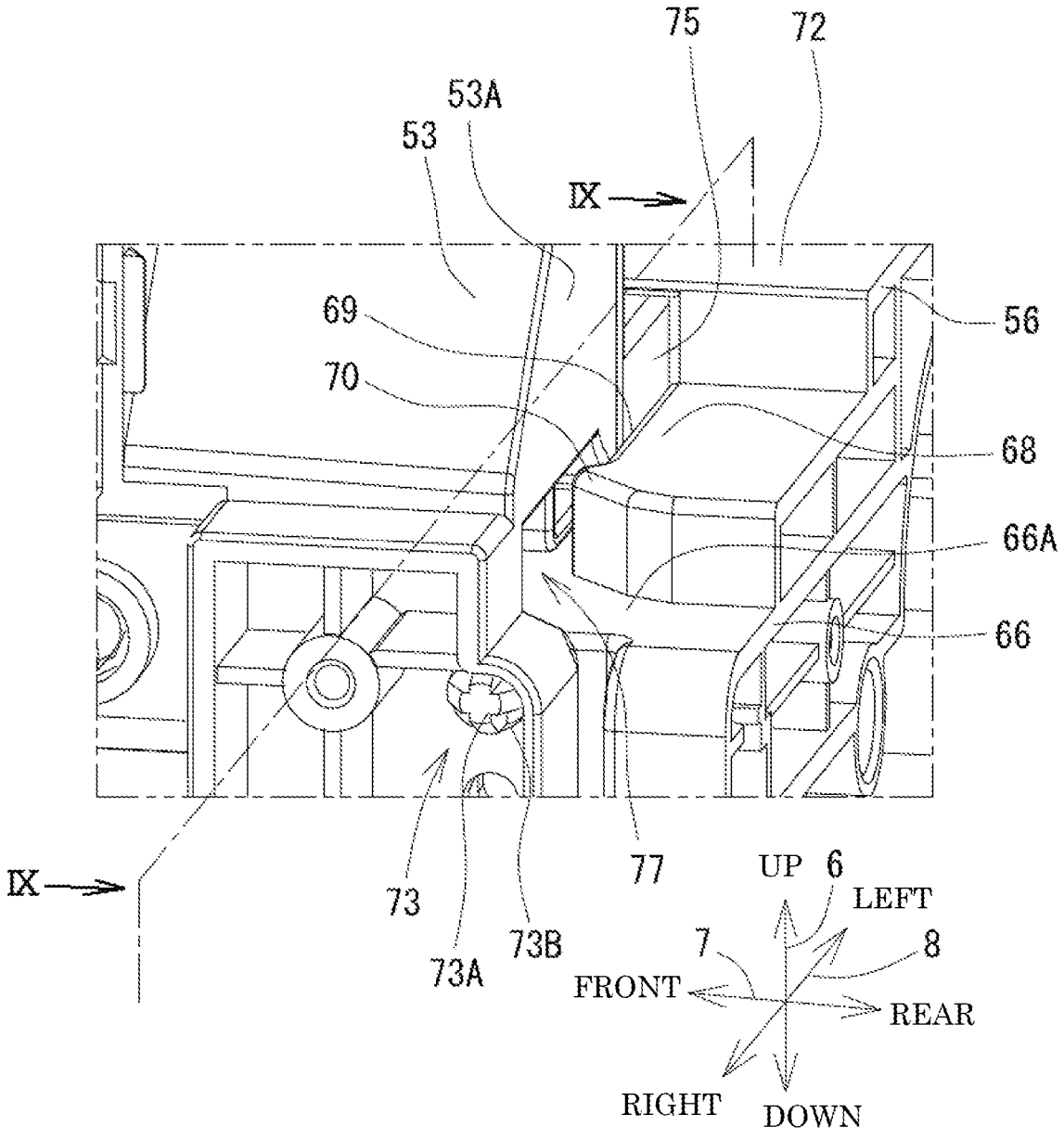
FIG. 8 is a partially enlarged view showing the configuration of the main part VIII of FIG. 4.
Figure 9:
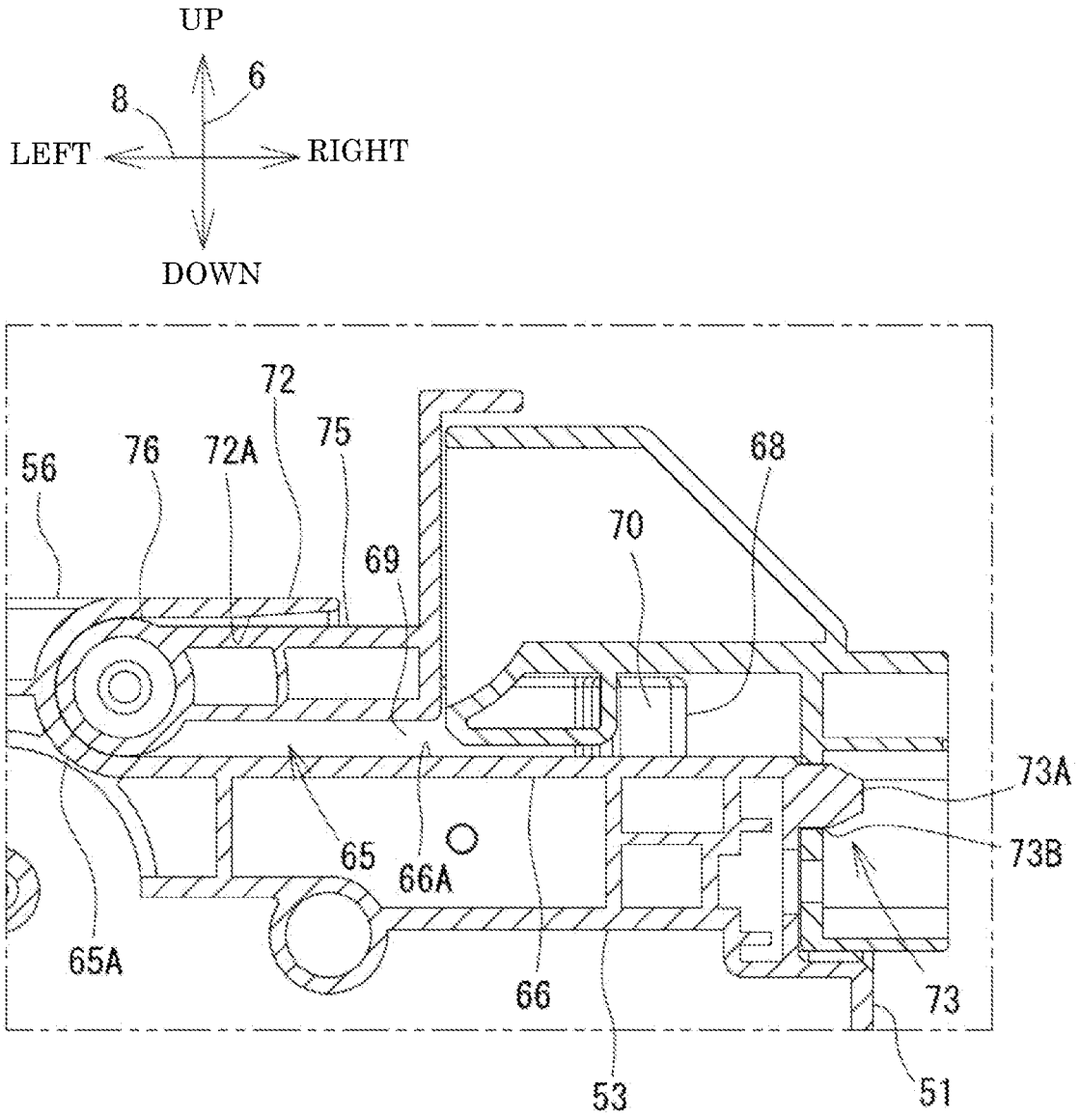
FIG. 9 is a cross-sectional view taken along the line IX-IX of FIG. 8.

As shown in FIGS. 8 and 9, the support plate 56 includes a support base 66 projecting toward the rear end 20B. An upper surface 66A of the support base 66 is a flat surface extending in the left-right direction 8. A slide member 75, which is described below, of the rear end 20B slidably contacts the upper surface 66A. In the present embodiment, the slide member 75 of the rear end 20B is supported by the upper surface 66A. As a result, the height position of the upper surface 66A of the support base 66 is set to a position that can support the rear end 20B at the same height level as the front end 20A.

On the upper surface 66A, a vertical wall 68 is formed to restrict the rear end 20B in the front-rear direction 7. The vertical wall 68 has a vertical surface 69 that is vertical to and extends from the upper surface 66A in the up-down direction. The vertical surface 69 faces the side surface of the rear end 20B when the fixing unit 20 is attached. That is, a side surface of the front side of the vertical wall 68 is the vertical surface 69. A projection 70 is formed on the vertical surface 69 at an end thereof on the foreside of the insertion direction of the fixing unit 20. The projection 70 projects from the vertical surface 69 in a direction of going away from the vertical surface 69 (corresponding to the first direction of the present disclosure). That is, the projection 70 projects from the vertical surface 69 in the front direction.

As shown in FIG. 9, a guide groove 65 is formed in the vertical surface 69 on the depth side of the insertion direction of the fixing unit 20. The guide groove 65 is fitted with the slide member 75 of the rear end 20B of the fixing unit 20, and slidably guides the slide member 75 in the insertion direction. The guide groove 65 is formed as one unit with the support plate 56. In addition, the guide groove 65, when fitted with the slide member 75, positions the rear end 20B in the up-down direction 6.

Specifically, on the depth side of the vertical surface 69, an upper wall 72 is formed to face the upper surface 66A. The upper wall 72 is formed above the upper surface 66A. A lower surface 72A of the upper wall 72 is a flat surface parallel to the upper surface 66A and is vertical to the vertical surface 69. The guide groove 65 is formed by being surrounded by the lower surface 72A of the upper wall 72, the upper surface 66A of the support base 66, and the vertical surface 69 of the vertical wall 68. That is, the guide groove 65 is a space surrounded by the upper surface 66A of the support base 66, the vertical surface 69 of the vertical wall 68, and the lower surface 72A of the upper wall 72. With this configuration, when the slide member 75 is inserted in and fitted with the guide groove 65, the slide member 75 is supported by the upper surface 66A of the support base 66, the vertical surface 69 of the vertical wall 68, and the lower surface 72A of the upper wall 72, and the slide member 75 is positioned in the up-down direction 6. In this way, the first support portion of the present disclosure is realized by the support base 66, vertical wall 68, and upper wall 72 that support the slide member 75.

The side frame 53 includes the slide member 75 (an example of the first supported portion of the present disclosure) that can be inserted in and fitted with the guide groove 65. That is, the slide member 75 is provided in the rear end 20B of the fixing unit 20. The rear end 20B is an end on the driven side to which the rotational driving force is input from the drive transmission portion 45 (see FIG. 3). The slide member 75 includes an engagement portion 76 formed at a tip thereof in the insertion direction. The engagement portion 76 is formed in the shape of a cylinder so that its outer circumference is contactable with a circular arc portion 65A, which is described below. When the fixing unit 20 is inserted, the engagement portion 76 is guided to the depth side of the guide groove 65 while in slide contact with the upper surface 66A of the support base 66. The engagement portion 76 is formed so that a predetermined fitting tolerance is secured when it is fitted with the guide groove 65. That is, the engagement portion 76 is configured to be fittable with the guide groove 65. When the engagement portion 76 is fitted with the guide groove 65, the rear end 20B of the fixing unit 20 is positioned in the up-down direction 6 by the guide groove 65, and the rear end 20B of the fixing unit 20 is supported movably in the insertion direction of the fixing unit 20.

The circular arc portion 65A (an example of the second positioning portion of the present disclosure) is formed in the guide groove 65 on the depth side of the insertion direction. That is, the guide groove 65 includes the circular arc portion 65A. The circular arc portion 65A closes an end of the guide groove 65 on the depth side of the insertion direction, and is formed in the shape of a circular arc in cross section. When the fixing unit 20 is inserted and the engagement portion 76 of the slide member 75 is inserted in the guide groove 65, the rear end 20B of the fixing unit 20 is positioned in the up-down direction 6. When the engagement portion 76 of the slide member 75 is further inserted to the circular arc portion 65A, the engagement portion 76 cannot be moved further toward the depth side. This causes the slide member 75 to be positioned in the up-down direction 6 by the circular arc portion 65A and causes the engagement portion 76 to be positioned on the depth side of the insertion direction.

In addition, as shown in FIG. 8, the side frame 53 includes a retreating portion 77 for retreating the projection 70 in the front direction. The retreating portion 77, when the fixing unit 20 has been attached to the attachment position, retreats the projection 70, in the front direction, from a side surface 53A of the side frame 53 that faces the vertical surface 69. Specifically, the side surface 53A is positioned on the same surface as the side surface of the rear side of the slide member 75, and the retreating portion 77 is an opening formed in the side surface 53A. The retreating portion 77 penetrates the side surface 53A of the side frame 53 in the front direction, and the opening size is large enough to allow the projection 70 to insert through. The retreating portion 77 is formed at a position facing the projection 70 when the fixing unit 20 has been attached to the attachment position. As a result, when the fixing unit 20 is positioned away from the attachment position, the projection 70 does not face the retreating portion 77. In that case, the projection 70 does not retreat from the side surface 53A in the front direction.

As shown in FIG. 9, the housing 29 is provided with a positioning mechanism 73 (an example of the first positioning portion of the present disclosure). The positioning mechanism 73 positions the fixing unit 20 in the left-right direction 8 when the fixing unit 20 is at the attachment position. The positioning mechanism 73 includes an engagement boss 73A and an engagement hole 73B. The engagement boss 73A is provided in the support plate 56. The engagement hole 73B is provided in the side frame 53. The engagement boss 73A is formed as a projection projecting rightward from the right-side surface of the support plate 56. The tip of the engagement boss 73A is formed in the tapered shape, and on the circumferential surface thereof, a hook having a cross shape is formed. The engagement hole 73B is formed as one unit with the rear end of the right side surface of the base frame 51 of the fixing unit 20. The engagement hole 73B is a through hole penetrating in the left-right direction 8, and is formed to have a size that is large enough to allow the engagement boss 73A to fit through. When the engagement boss 73A is fitted through the engagement hole 73B, the hook is engaged with the rim of the engagement hole 73B, which restricts the engagement boss 73A from being removed. In this way, when the engagement boss 73A is engaged with the engagement hole 73B, the fixing unit 20 is fixed to a position in the left-right direction 8.

In the present embodiment, the engagement boss 73A and the engagement hole 73B are in a positional relationship in which the center axis of the engagement boss 73A matches the center of the engagement hole 73B when the fixing unit 20 is disposed at the attachment position. That is, when the fixing unit 20 is not disposed at the attachment position, the center axis of the engagement boss 73A does not match the center of the engagement hole 73B, and the engagement boss 73A is shifted in the front-rear direction 7. The shift amount of the positional shift is equal to an amount by which the fixing unit 20 is pressed in the front direction by the projection 70 formed on the vertical surface 69. That is, the shift amount of the positional shift is set to be equal to the projection amount of the projection 70. It is noted that the tip of the engagement boss 73A is formed in the tapered shape. As a result, even when the engagement hole 73B is shifted from the engagement boss 73A by the shift amount, the tip of the engagement boss 73A can be inserted in the engagement hole 73B that has been shifted by the shift amount.

Figure 10A:
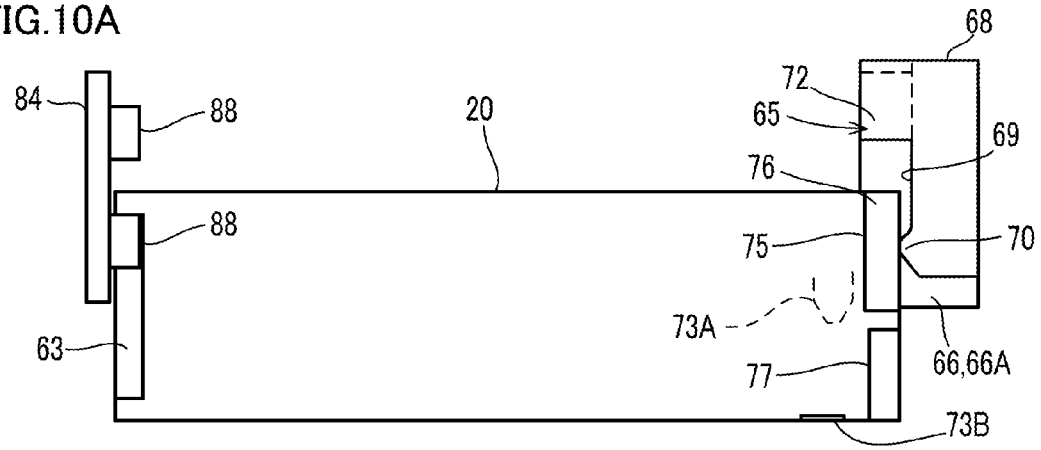
FIGS. 10A through 10D are schematic diagrams explaining the operation of attaching the fixing unit.

With the above-described configuration of the fixing unit 20 and the mechanism for supporting it, the fixing unit 20 is attached to the housing 29 as follows. That is, in order to attach the fixing unit 20 to the inside of the image forming portion 14, the worker opens the side cover 49 (see FIG. 1) and exposes the support plates 55 and 56. Subsequently, the projection ribs 88 of the support member 82 are inserted in the guide groove 63 of the front end 20A, and the slide member 75 of the rear end 20B is placed on the upper surface 66A of the support base 66 (see FIG. 10A). At this time, the projection 70 of the vertical wall 68 restricts the rear end 20B in the front direction. As a result, when the fixing unit 20 starts to be inserted, the fixing unit 20 is shifted toward the support plate 55. This causes the projection ribs 88 to be inserted toward the depth side of the guide groove 63. That is, the fitting width of the projection ribs 88 and the guide groove 63 is larger than the fitting width corresponding to the attachment position described below. This ensures that the fixing unit 20 is guided in a secured manner in the insertion direction, and facilitates the worker to smoothly insert the fixing unit 20 toward the attachment position.

Figure 10B:
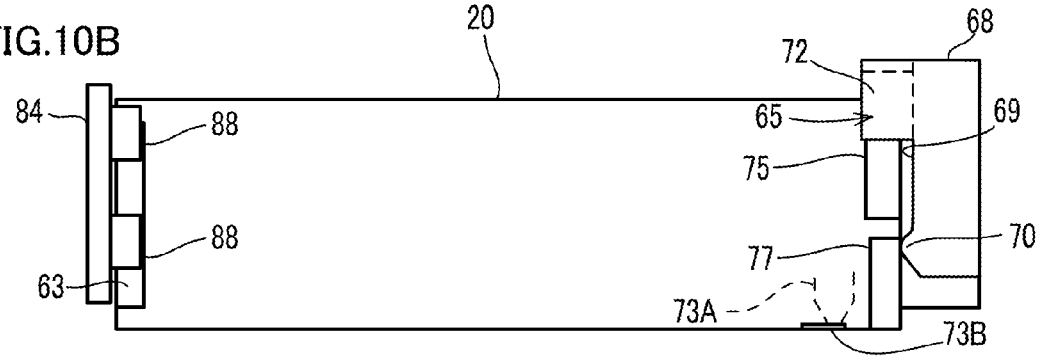
Figure 10C:
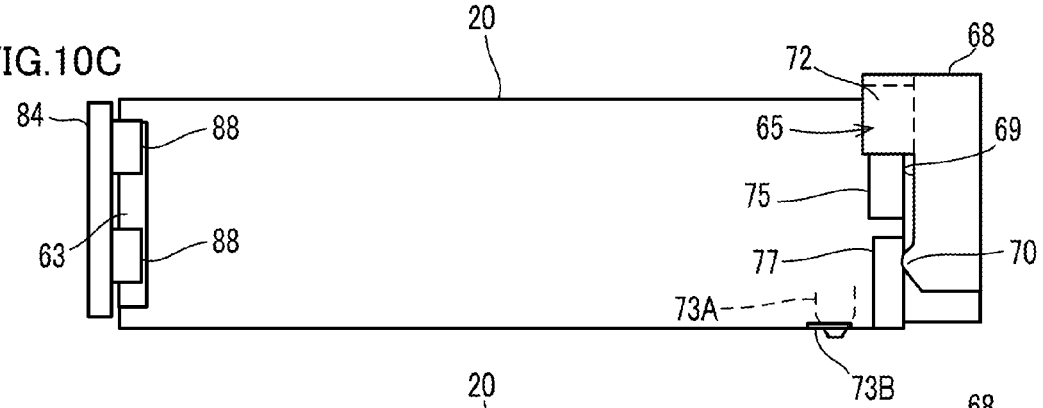
Figure 10D:
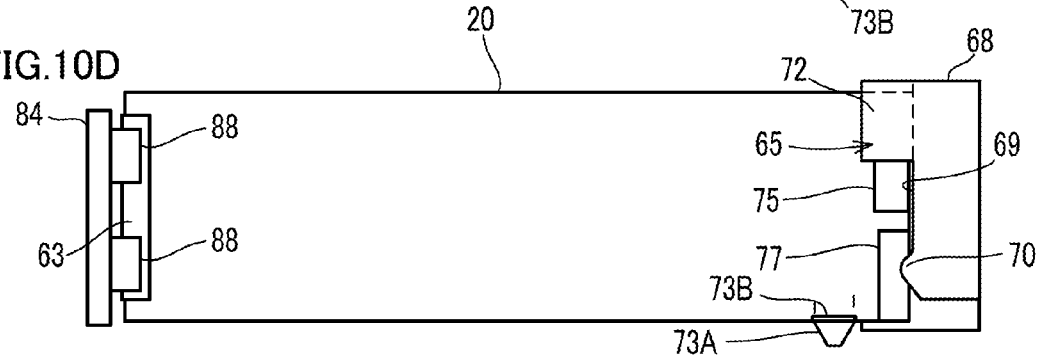

When the fixing unit 20 is further inserted toward the attachment position, and the fixing unit 20 is disposed at the position where the projection 70 faces the retreating portion 77 (see FIG. 10B), the tip of the engagement boss 73A fits into the engagement hole 73B. When the fixing unit 20 is further inserted, during the insertion process, the position of the engagement hole 73B starts to be moved in the rear direction as guided by the slant surface of the tapered-shaped tip of the engagement boss 73A. That is, the fixing unit 20 starts to be moved in the rear direction (see FIG. 10C). In addition, the projection 70 is inserted in the retreating portion 77. Subsequently, when the engagement portion 76 of the slide member 75 reaches the circular arc portion 65A, and the fixing unit 20 is disposed at the attachment position, the center axis of the engagement boss 73A matches the center of the engagement hole 73B, and the side surface of the slide member 75 of the fixing unit 20 contacts the vertical surface 69 (see FIG. 10D). In this state, the fixing unit 20 is moved in the rear direction by the shift amount from the position at which the insertion was started. At this time, the fitting width of the projection ribs 88 and the guide groove 63 is smaller than the fitting width as of the insertion start, and it becomes the smallest fitting width. That is, at this time, the restriction made by the fitting width to the adjustment width of the height position adjustment performed by the height adjustment mechanism 80 becomes the smallest. This makes it possible to secure enough adjustment width in the up-down direction 6 in the height position adjustment performed by the height adjustment mechanism 80.

It is noted that although in the above-described embodiment, the height adjustment member 84 is described as the height adjustment portion of the present disclosure, the height adjustment portion of the present disclosure may be realized by a member other than the height adjustment member 84. That is, the present disclosure is applicable to any configuration as far as it can adjust the height position of the fixing unit 20.

It is also noted that although in the above-described embodiment, the retreating portion 77 is configured as an opening. However, not limited to an opening, the retreating portion 77 may be, for example, a dent that is generated by denting the side surface 53A of the side frame 53 in the front direction. That is, the retreating portion 77 is applicable to any configuration as far as it can retreat the projection 70 in the front direction.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a fixing unit attached to an apparatus main body of the image forming apparatus;

a first support portion fixed to the apparatus main body and configured to fit with and position a first supported portion, which is an end of the fixing unit, in an up-down direction and to support the first supported portion movably in insertion direction of the fixing unit toward an attachment position;

a second support portion provided movably in the up-down direction with respect to the apparatus main body and configured to fit with and position a second supported portion, which is another end of the fixing unit, in the up-down direction and to support the second supported portion movably in the insertion direction; and a height adjustment portion configured to adjust height position of the fixing unit by moving the second support portion in the up-down direction, wherein the first support portion includes a vertical surface facing the first supported portion and extending in the up-down direction, and the vertical surface has a projection at an end thereof on foreside of the insertion direction, the projection projecting from the vertical surface in a first direction of going away from the vertical surface, and the image forming apparatus further comprises a retreating portion configured to, when the fixing unit has been attached to the attachment position, retreat the projection, in the first direction, from a side surface of the first supported portion that faces the vertical surface.

2. The image forming apparatus according to claim 1, wherein the retreating portion is an opening formed in the side surface of the first supported portion.

3. The image forming apparatus according to claim 1, wherein the first supported portion is provided at a driven side end of the fixing unit to which a rotational driving force is input, and the second supported portion is provided at an end of the fixing unit that is opposite to the driven side end.

4. The image forming apparatus according to claim 1, further comprising a first positioning portion configured to, when the fixing unit is attached to the attachment position, position the fixing unit to the attachment position by moving the fixing unit toward the vertical surface of the first support portion.

5. An image forming apparatus comprising:

a fixing unit attached to an apparatus main body of the image forming apparatus;

a first support portion fixed to the apparatus main body and configured to fit with and position a first supported portion, which is an end of the fixing unit, in an up-down direction and to support the first supported portion movably in insertion direction of the fixing unit toward an attachment position;

a second support portion provided movably in the up-down direction with respect to the apparatus main body and configured to fit with and position a second supported portion, which is another end of the fixing unit, in the up-down direction and to support the second supported portion movably in the insertion direction; and a height adjustment portion configured to adjust height position of the fixing unit by moving the second support portion in the up-down direction, wherein the first support portion includes a vertical surface facing the first supported portion and extending in the up-down direction, and the vertical surface has a projection at an end thereof on foreside of the insertion direction, the projection projecting from the vertical surface in a first direction of going away from the vertical surface, and the first support portion further includes a second positioning portion configured to, in a state where the fixing unit has been attached to the attachment position, position the first supported portion of the fixing unit in the up-down direction, and position the first supported portion on depth side of the insertion direction.

* * * * *